United States Patent [19]

Tuten et al.

[11] 4,402,391

[45] Sep. 6, 1983

[54] SELECTIVE SCRAP METAL COLLECTION APPARATUS

[75] Inventors: William J. Tuten, Scottsdale; Kennith D. Crosby, Carefree; Harold W. Black, Mesa, all of Ariz.

[73] Assignee: Creative Technology Inc., Scottsdale, Ariz.

[21] Appl. No.: 211,739

[22] Filed: Dec. 1, 1980

[51] Int. Cl.[3] ..... G07F 7/06

[52] U.S. Cl. ..... 194/4 C; 177/165

[58] Field of Search ..... 73/1 B; 194/4 C, 4 D, 194/4 R; 177/165; 414/21

[56] References Cited

U.S. PATENT DOCUMENTS

| | | | |
|---|---|---|---|
| 3,124,206 | 3/1964 | Burke | 177/165 X |
| 3,850,023 | 11/1974 | McDonald | 73/1 B |
| 3,869,005 | 3/1975 | Williams, Jr. et al. | 177/165 X |
| 3,939,332 | 2/1976 | Williams | 177/165 |
| 3,966,000 | 6/1976 | Allen | 177/165 X |
| 4,029,162 | 6/1977 | Krolick | 177/165 |
| 4,179,018 | 12/1979 | Miller | 194/4 R |

*Primary Examiner*—Stanley H. Tollberg
*Attorney, Agent, or Firm*—Harry M. Weiss

[57] ABSTRACT

Unmanned apparatus for collecting scrap aluminum cans and for compensating depositors of scrap aluminum cans based on the weight of the aluminum cans deposited including a microprocessor control structure which produces control signals to control the operation of the apparatus including the dispensing of compensation, calibrating the weighing structure, and in response to alarm signals produced by operating components of the apparatus, to display the existence of any such alarm conditions, to identify their source and to deenergize the apparatus until the alarm causing conditions are corrected.

49 Claims, 14 Drawing Figures

118
120
K2
+ −
FILTER
T1
121
122
123
126
P1
P2
P3
P6
OB
OA
RET
CONVEYOR DR.
MTR. RLY. DR.
SCALE DUMP
TOKEN DISP.
QTR. DISP. DR.
TOP. DET
DISP. MTR. INH.
PENNY DISP. DR.
NICK. DISP. DR.
V2 AC
+12 V
+5 V
−5 V
BREAKERS
DSP. CLEAR
ALARM DVR.
CAN DETECT
GND
GND
+SENSE
−EXCIT
CALR
+EXCIT
−SENSE
CONNECTOR
J1
MONEY CNTR.
WEIGHT CNTR.
138
TO FIG. 5B
TO FIG. 5C

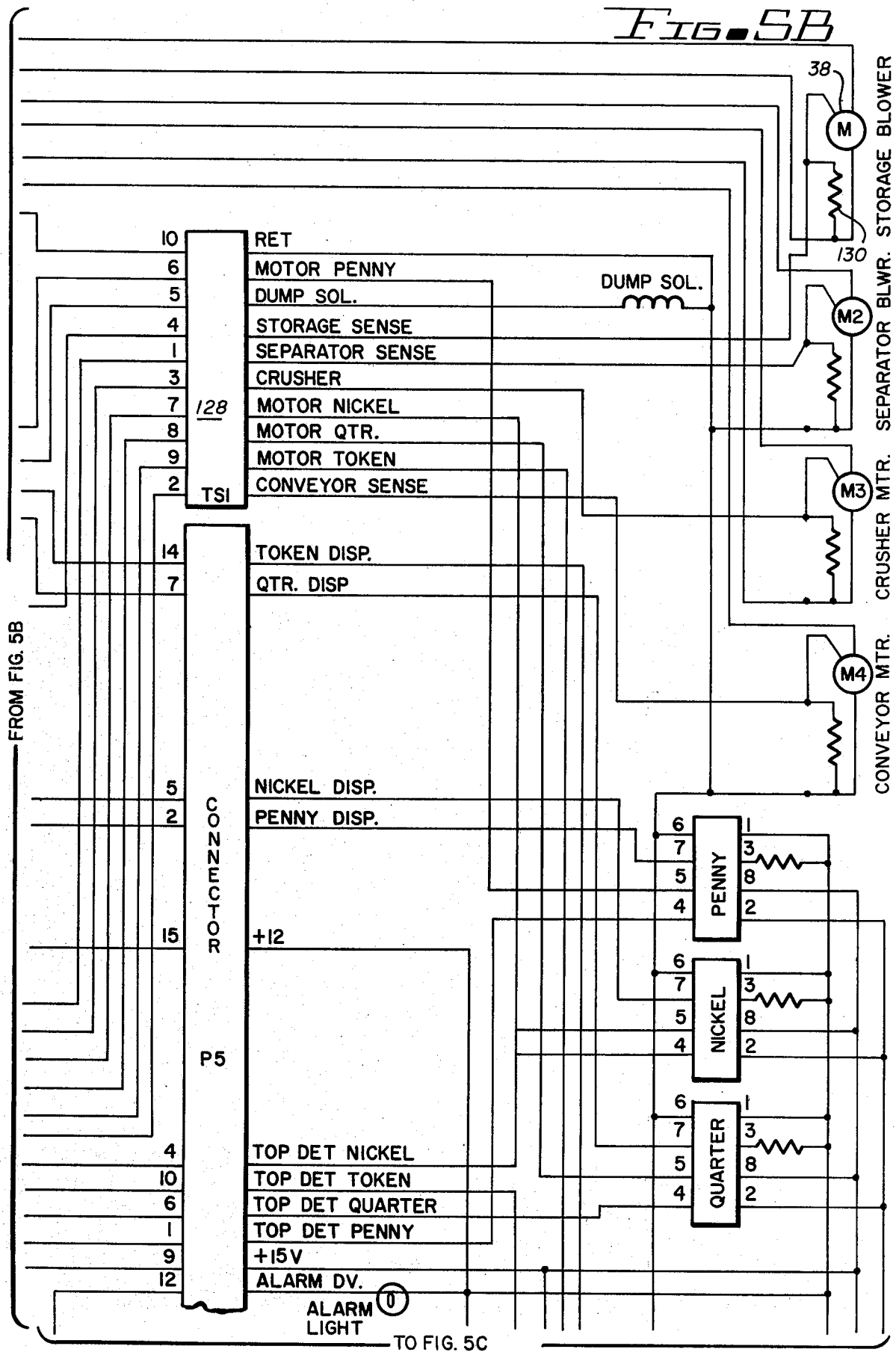
FIG. 5B
38
M
130
STORAGE BLOWER
M2
SEPARATOR BLWR.
M3
CRUSHER MTR.
M4
CONVEYOR MTR.
DUMP SOL.
10 RET
6 MOTOR PENNY
5 DUMP SOL.
4 STORAGE SENSE
1 SEPARATOR SENSE
3 CRUSHER
7 MOTOR NICKEL
8 MOTOR QTR.
9 MOTOR TOKEN
2 CONVEYOR SENSE
128
TSI
14 TOKEN DISP.
7 QTR. DISP
5 NICKEL DISP.
2 PENNY DISP.
15 +12
CONNECTOR
P5
4 TOP DET NICKEL
10 TOP DET TOKEN
6 TOP DET QUARTER
1 TOP DET PENNY
9 +15V
12 ALARM DV.
ALARM LIGHT
PENNY
NICKEL
QUARTER
FROM FIG. 5B
TO FIG. 5C +5
GND
+12
-5
CONNECTOR
25,26
C,D
1,2,3
ABC
27,28
E,F
18,V
P,13
8
SPI
K
MONEY CNTR.
19
+15V RET
WEIGHT CNTR.
U
+15V RET
SPARE
5
DISP. MTR. INHIB.
7
TOKEN DISP.
J
ALARM DRIVER
T
98
PENNY DISP.
X
DIME DISP.
Y
SCALE DUMP
22
CONVEYOR MTR. DR.
23
MOTOR RELAY DR.
24
1/2 AC
21
P1
OPTICAL COUPLER TIL113
LATCH (MC14174)
TO FIG. 6B
90

A/D
SW2
SW1
VPB
VCC
VSS
AG
TP2
102
+5
TOKENS
PENNIES
DIMES
RESTAR (MC1455)
INPUT BUFFER (MC14503)
U5
U6
U4
FROM FIG. 6C
TO FIG. 6D

+5
2
6
+5
12
6
3
4
16
2
9
1
14
15
131
8
13
5
10
11
7
INSTRUMENT AMP.
-5
+5
7
2
6
OP. AMP.
5
3
1
4
-5
+5
-5
E
CALR
D
+SENSE
4
-SENSE
M,11
+EXCIT
N,12
-EXCIT
F
SPARE
CONNECTOR
FROM FIG. 6C
W
CAN DETECT
6
TOP DET PENNY
2
TOP DET DIME
PI
BREAKERS

SELECTIVE SCRAP METAL COLLECTION APPARATUS

BACKGROUND OF THE INVENTION

1. Field of the Invention

This invention is in the field of apparatus for selectively recovering, or collecting, scrap metal of a given type such as aluminum containers and for compensating depositors of such scrap based on the weight of said metal so collected.

2. Description of the Prior Art

The most relevant prior art known to applicant is that found in U.S. Pat. No. 4,179,018 which issued on Dec. 18, 1979 to John H. Miller and is entitled Method and Apparatus for Selective Recovery of Metal Containers. The patent to Miller discloses apparatus in which non-reusable aluminum cans such as are used to package soft drinks and malt cereal beverages are segregated from other materials such as tinplated steel cans that may be deposited in the apparatus. A start button, or switch is pushed by the depositer to start the operation of the apparatus. The deposited materials are conveyed by a conveyor belt to a magnetic separator that separates magnetic, ferrous, materials such as tinplated steel cans from nonmagnetic materials and stores the ferrous materials in a storage bin for such magnetic materials.

More dense non-metallic materials are collected at the bottom of a pneumatic classifier conveyor that transports the aluminum, non-ferrous, metal containers to a crusher. The aluminum cans so transported are crushed and then weighed. After being weighed, the crushed aluminum is conveyed by a pneumatic stacker conveyor and deposited into an inclined storage compartment located at the top of the apparatus. The storage compartment is located to facilitate the unloading of the storage compartment into a suitable conveyance, such as a truck, so that the aluminum collected can be taken to a plant where it can be recycled.

The apparatus is provided with a compensation dispenser which dispenses coins, tokens, or other symbols of value, the amount, or value, of which is determined by the weight of the non-ferrous materials that pass through the crusher and as weighed by the weighing means during operation of the collection apparatus.

Apparatus such as that disclosed in the Miller patent is designed to be unattended and is frequently placed in the parking lots of shopping centers. Such a location makes it easier for persons who patronize the retail stores located in a shopping center and purchase beverages which are packaged in aluminum cans to dispose of such cans after consuming their contents and obtain a return on their investment. The recovery of scrap aluminum from this source saves energy and raw materials that would otherwise be used to produce virgin aluminum while simultaneously reducing problems associated with disposing of such cans after the contents have been consumed.

Because such apparatus is unattended, problems can occur, which if not promptly detected and remedied, can result in a malfunction in which the depositors would not be paid for cans deposited, for example. Such malfunctions of the apparatus would work against the conservation ethic that the apparatus is intended to encourage.

It is not uncommon for people to deposit metals into the apparatus other than aluminum. While the apparatus segregates magnetic materials such as tinplated steel cans from non-magnetic materials, the value of tinplated steel cans is so minimal at this time as not to make it economical to collect them. There, thus, is a need to notify depositors when they deposit a tinplated steel can so that the depositor will not put anymore tin cans into the apparatus. There is also a need, because the apparatus is unattended, that the apparatus essentially diagnose whatever it is that caused it to cease operating and to provide some guidance to a serviceman who is attempting to correct its problems.

SUMMARY OF THE INVENTION

The present invention provides improved metal collection apparatus for collecting selected metals such as aluminum primarily in the form of used aluminum cans and for compensating the depositors for such metal cans based on the weight of the selected metal collected. The collecting apparatus is free-standing and is designed to function unattended by a human operator. The apparatus is provided with a hopper into which depositors place material, aluminum cans, which the machine is designed to collect. The depositor then pushes a start button in the vicinity of the hopper to initiate operation of the apparatus. The deposited material is carried from the hopper to a classifier by an endless conveyor belt. The classifier segregates magnetic, or ferrous metal, from non-magnetic materials.

Heavier, or more dense, non-magnetic materials fall to a pneumatic conveyor that carries aluminum cans which are of a lesser density to a crusher. More dense non-magnetic materials collect in the bottom of the pneumatic conveyor in a bin so provided. The aluminum material which is conveyed by the pneumatic conveyor of the classifier to the crusher where the material is crushed so that it is more compact and, thus, occupies significantly less space when stored. After passing through the crusher, the crushed material is weighed, its weight noted, and the crushed material, after it has been weighed, is dumped into a stacker conveyor which transports the crushed aluminum cans to a storage bin in which they are stored until forwarded to a recycling plant, for example.

A digital electronic controller is provided to control the energization of the motors that drive the conveyors and the crusher and provide power to the classifier. The weigher produces an analog signal that is digitized by an A to D converter. The controller, based on the weight of the metals measured by the load cell of the weigher, causes the compensation dispenser to dispense an appropriate amount of compensation in the form of coins or tokens, for example, to the depositor. The apparatus is provided with motor alarm circuits which produce an alarm signal if any one of the motors is not running properly when energized. The coin dispensing apparatus will produce alarm signals if no coins or tokens are available to be dispensed.

A detector is provided which produces an alarm signal each time a piece of magnetic material, such as in a steel can, is segregated from the materials deposited, as such can falls into the receptical for magnetic material. An alarm will also be produced when the container or recepticle for magnetized material is full. Another detector is provided which produces an alarm signal if a jam occurs in the classifier conveyor, since such a jam will prevent aluminum cans, for example, from being fed into the crusher. The electronic controller also includes circuit means for calibrating the load cell which is used to measure the weight of the aluminum cans deposited in the apparatus to assure that is accurately weighing the material dumped into the weighing hopper of the weigher.

The digital electronic controller calibrates the magnitude of the calibration resistor to that of the load cell before each cycle of operation. This calibration results in a significant increase in the accuracy of measuring the weight of aluminum cans deposited into apparatus, notwithstanding the replacement of the load cell or even of the controller, or changes in temperature or variations in the power supply.

BRIEF DESCRIPTION OF THE DRAWING

Other objects, features and advantages of the invention will be readily apparent from the following description of certain preferred embodiments thereof, taken into conjunction with the accompanying drawings, although variations and modifications may be effected without departing from the spirit and scope of the concepts of the disclosure, and in which:

FIGS. 5A, 5B and 5C are a schematic wiring diagram of the control system.

DESCRIPTION OF THE PREFERRED EMBODIMENTS

Figure 1:
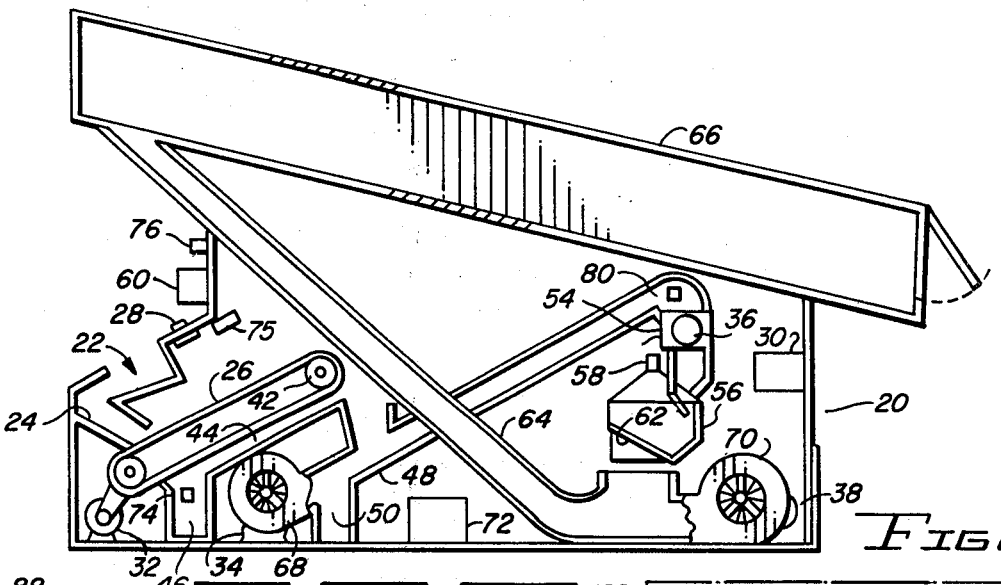
FIG. 1 is a schematic side view of the collection apparatus with arrows indicating the flow path through the apparatus.

In FIG. 1 collection apparatus 20 is illustrated. Collection apparatus 20 is an improvement over the apparatus described and claimed in U.S. Pat. No. 4,179,018 dated Dec. 18, 1979, the disclosure of which is incorporated by reference into this application. Collection apparatus 20 is free standing, and is frequently located in public places such as the parking lots of shopping centers and operates unattended.

A depositor who has collected a supply of used aluminum cans, or aluminum scrap, in any form, particularly of gauge not significantly thicker than that of aluminum cans deposits such waste material in hopper 22. The material falls down chute 24 until it contacts the upper surface of endless conveyor belt 26. The depositor, after depositing the waste material in hopper 22, pushes start button 28 which initializes controller 30 and starts the operation of collector apparatus 20. Controller 30, which is a digital electronic controller, details of which will be more fully set forth later, causes belt conveyor motor 32, classifier motor 34, crusher motor 36 and a stacker motor 38 to be energized with electrical energy in the preferred embodiment. Conveyor belt 26 transports the material deposited onto it to magnetic separator 42 which cooperates with the upper end of conveyor belt 26 to separate out, or segregate, ferrous material. Ferrous materials such as tinplated steel cans will fall down through chute 44 and will be collected in ferrous metal receptical 46. Non-ferrous metals such as aluminum containers, or cans, are discharged into the entrance of pneumatic classifier conveyor 48. Denser non-magnetic waste materials, substantially more dense than aluminum cans, fall into or collect in recepticle 50 which is located under conveyor 48. Aluminum cans, or containers, are conveyed upwardly by the pneumatic classifier conveyor 48 and are discharged into crusher 54. Aluminum cans, after being crushed, are discharged into weighing hopper, or container, 56. The weight of the material in hopper 56 is measured by conventional load cell 58. The voltage across the load cell, which is an analog voltage, is digitized, as will be described later and is applied to controller 30 which based on the difference in weight between the weight of hopper 56 with crushed cans in it, and the weight of hopper 56 after the contents have been dumped, calculates the amount of compensation to be paid to the depositer and causes compensation dispenser 60 to dispense the proper amount of coins, tokens, etc. The contents of hopper 56 are dumped by energizing a solenoid to open door 62 of hopper 56. The crushed non-ferrous metal from hopper 56 falls into the pneumatic stacker conveyor 64 which transports the crushed aluminum material to storage compartment 66, where the aluminum is collected and stored until a sufficient load, or amount is collected which is then dumped into a truck, for example, to be taken to a facility where the scrap metal can be recycled.

Controller 30 controls the energization of four motors, conveyor motor 32, classifier motor 34, which drives the blower 68, stacker motor 38 which drives the blower 70, and crusher motor 36, which provides the energy for crusher 54. In addition, controller 30 produces control signals which cause compensation dispenser 60, to dispense quarters, nickels, pennies, and tokens, in the preferred embodiment. A multihopper dispenser such as one designated as model 33-22-000, which is manufactured by National Rejectors Inc. (Div. of UMC Ind. Inc.) of Hot Springs, Ark., may be utilized as compensation dispenser 60. Collector 20 is provided with an out-of-order display 72 which identifies the function that is out of order as sensed by controller 30. Out-of-order display 72 is positioned within the housing of apparatus 20.

Controller 30 is provided with a calibration circuit to calibrate the load cell 58, to make certain that it is properly calibrated, i.e. it will accurately measure the weight of the material deposited in hopper 56 and dumped into stacker conveyor 64. Controller 30 also senses any alarm signals produced as a result of a motor failure. Coin dispenser 60 is provided with means for producing alarm signals if no coins are available to be dispensed or if dispenser 60 is jammed. In addition, one of the major causes of problems with the prior art collectors of the type disclosed in U.S. Pat. No. 4,179,018 is that ferrous metal receptical 46 will become filled, which creates a jam and renders apparatus 20 inoperative. A conventional electromagnetic infrared radiation detector 74 is mounted at the upper end of receptical 46. Each time a can of ferrous metal, for example, falls into receptical 46, it will break or interrupt the light beam across the entrance to receptical 46. The breaking of the beam is evidence that a tinplated steel can, for example, was deposited in hopper 22. The breaking of the light beam produces an alarm signal which causes buzzer 75 to sound to indicate to the depositer that a ferrous metal can has been deposited. If the signal is continuous i.e.

the beam of electromagnetic energy at the entrance to receptical 46 remains broken for a substantial period of time measured in a fraction of a second, such a condition indicates that receptical 46 is full, which is a cause for a second alarm condition which occurs 30 seconds later.

A second electromagnetic detector 80 is mounted in the discharge nozzle of classifier conveyor 48 to sense if a jam has occurred. If a jam is sensed by detector 80, controller 30 prevents additional cans from being fed into the crusher 54. Controller 30 also produces a control signal to energize a solenoid which is not illustrated in FIG. 1 to open door 62 of weighing bucket 56 after the contents of bucket 56 have been weighed. Controller 30 also calculates the weight of the material dumped into conveyor 64 from the digitized voltages across load cell 58 by comparing the weight of weighing bucket 56 after dumping its contents with the weight of bucket 56 and its contents immediately prior to its being dumped. Based on the weight of material dumped from bucket 56, controller 30 calculates the compensation to be paid to the depositer and energizes the appropriate coin dispensers of compensation dispenser 60 to provide the computed amount of compensation. Systems are provided which produce alarm signals which when applied to controller 30 cause controller 30 to light the appropriate signal light on out-of-order display 72 to identify the cause of the failure. For certain types of failures controller 30 is programmed to respond by reenergizing the component which was the source of the alarm signal to see if the problem can be cleared or corrected, and if the problem is not corrected, controller 30 will deenergize all the motors and provide a signal at status signal light 76 which identifies to would be depositors that apparatus 20 is non-operational.

While it is not a part of this invention, it is contemplated that at such time as collector 20 is deenergized or inactivated by controller 30, controller 30 can send an appropriate signal to a central office by radio or telephone indicating that there is a problem at a given site where the apparatus 20 is located so that a serviceman can be promptly sent to the site to correct it.

The hardware comprising controller 30 is illustrated in FIGS. 2–6. In the systems schematic of FIG. 2, the microprocessor 84, a standard microprocessor, in the preferred embodiment a Motorola 6802, which is provided with a clock circuit 86, a restart circuit 88 and an interrupt and power down circuit 90. As is conventional, microprocessor 84 is connected by data and address buses to memory 92 and addressable input/output ports 94. The I/O ports 94 are connected to sensors through filter network 96 and through driver circuits 98 control signals to control the operation of the apparatus 20 are amplified to useful levels. The output of load calibration circuit 100 which is an analog voltage, is digitized by A to D converter 102. All of the components of controller 30 are standard commercially available electronic components.

Figure 3:
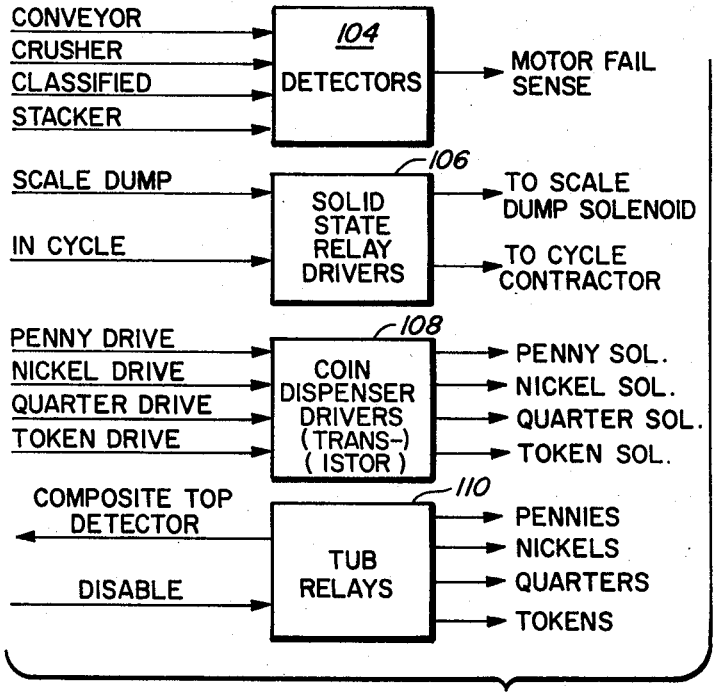
FIG. 3 is a schematic block diagram of the driver board of the controller.

In FIG. 3 additional details of some of the sources of signals supplied to microprocessor 84 and of the signals used to control apparatus 20 are illustrated. Alarm signals from classifier, conveyor, crusher and stacker motors 32, 34, 36 and 38 are applied to detector circuit 104 which produces a motor fail signal if any of the signals applied to circuit 104 represents an alarm condition.

The signals applied to solid-state relay driver circuits 106 cause the weighing hopper, or bucket, 56 to dump its contents by opening dump door 62. The in-cycle signal from MPU 84 energizes the relays that provide power to motors 32, 34, 36, 38, and 40. Pay-out signals, as produced by MPU 84, are applied to driver circuit 108. Alarm signals from dispenser 60 indicating that the coin tubes of dispenser 60 are full are applied to circuit 110. If dispenser 60 is functioning properly, no alarm signal is transmitted to MPU 84. If an alarm condition exists, an alarm signal is transmitted to MPU 84 which sends back a disable signal which stops the dispensing of coins or tokens and shuts down apparatus 20, as is described below.

Figure 4:
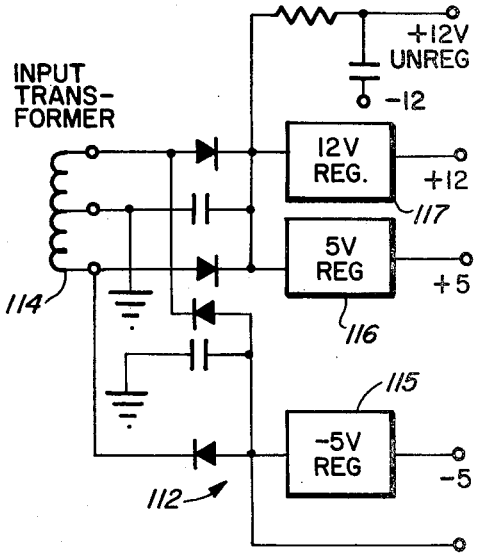
FIG. 4 is a schematic diagram of the power supply of the controller.

FIG. 4 is a schematic of the power supply 112 for controller 30. Commercially available power 118 volt single phase AC is applied to the system through transformer 114. The voltage is rectified to +12, and ±5 volt regulated DC power which is produced by commercially available voltage regulators 115, 116, and 117. Circuit 112 also produces unregulated +12 volt DC current.

Figure 5A:
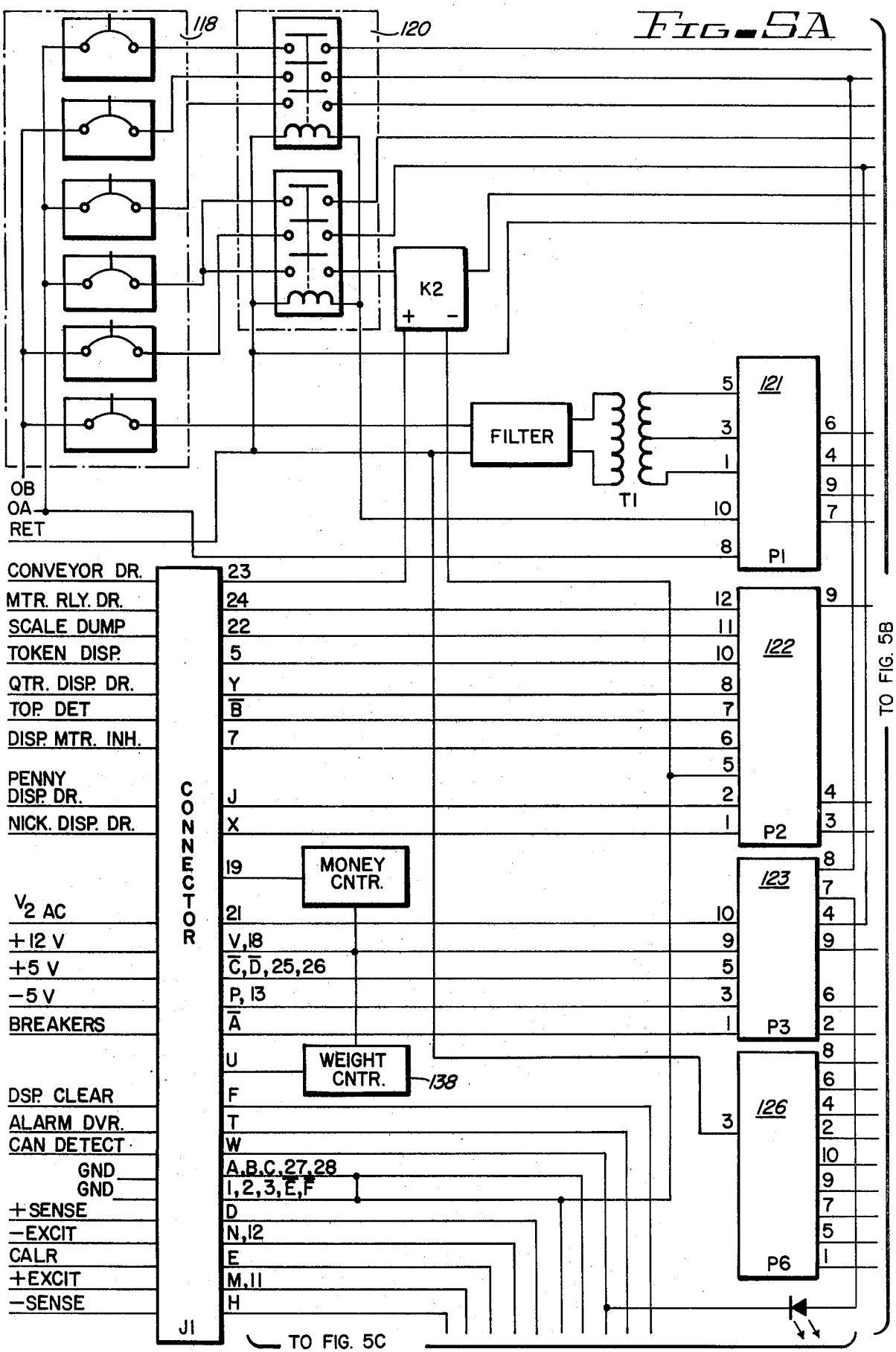
Figure 5C:
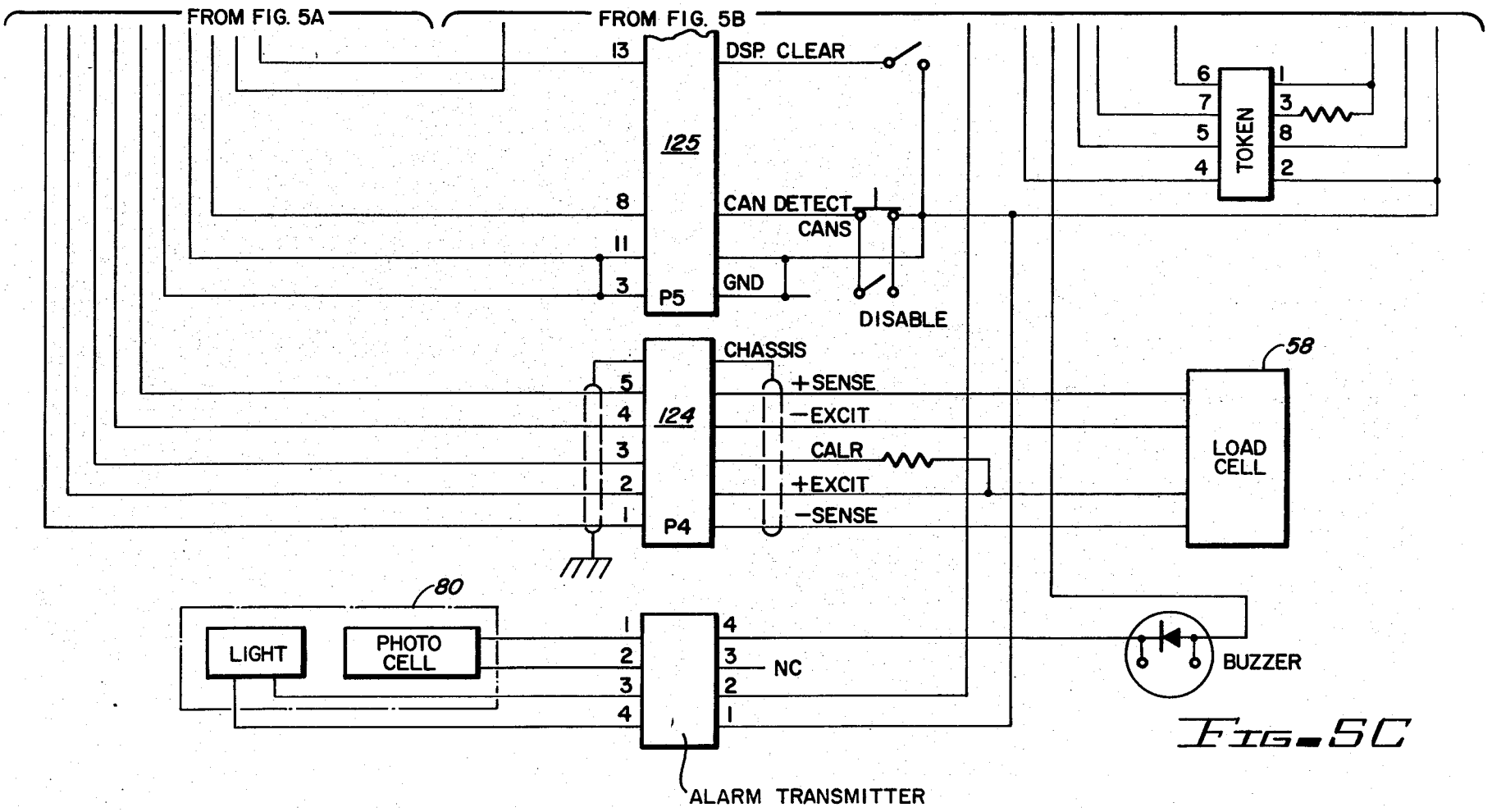
Figure 6A:
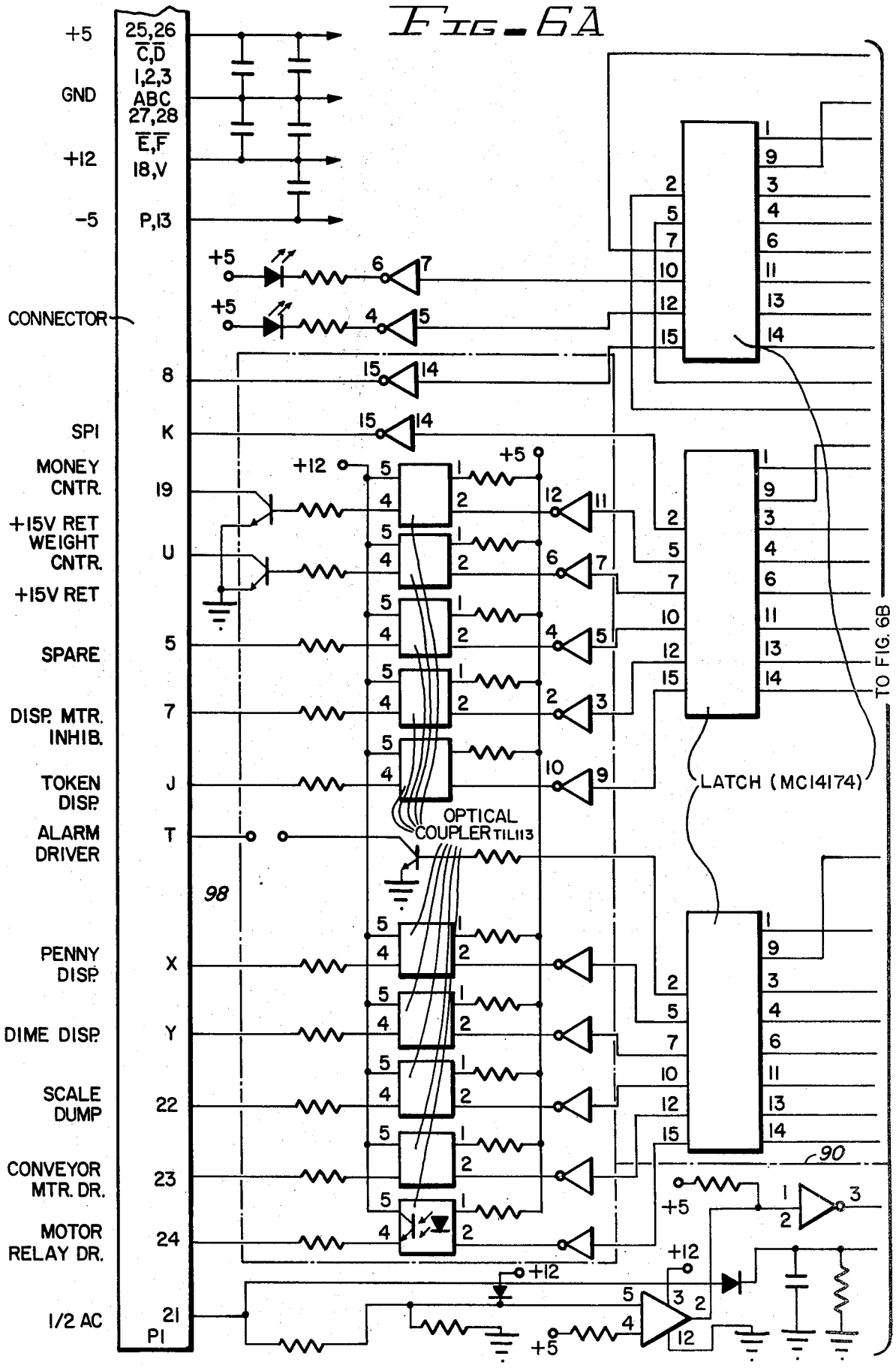
FIGS. 6A, 6B, 6C and 6D are a schematic wiring diagram of the microprocessor board.
Figure 6B:
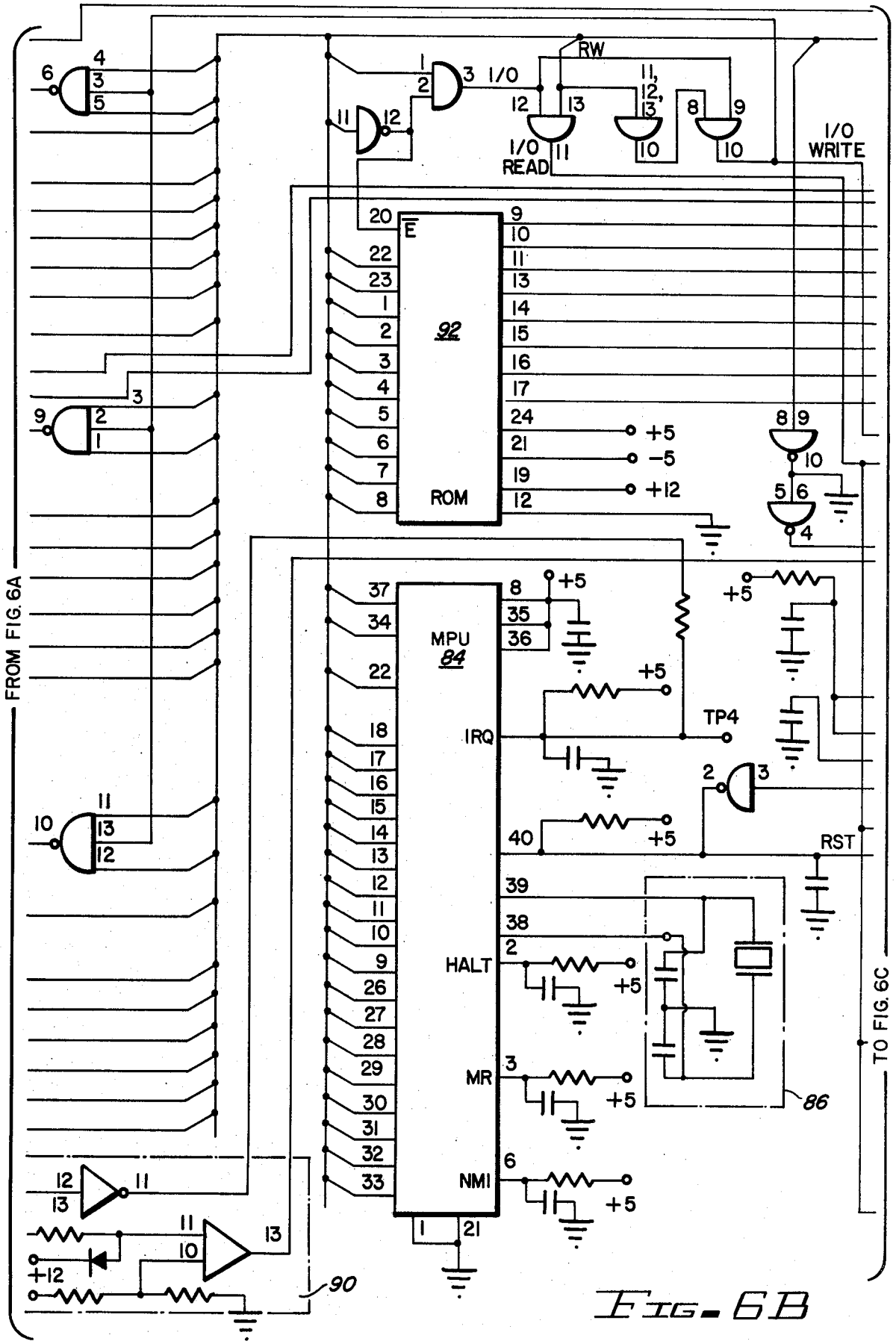
Figure 6C:
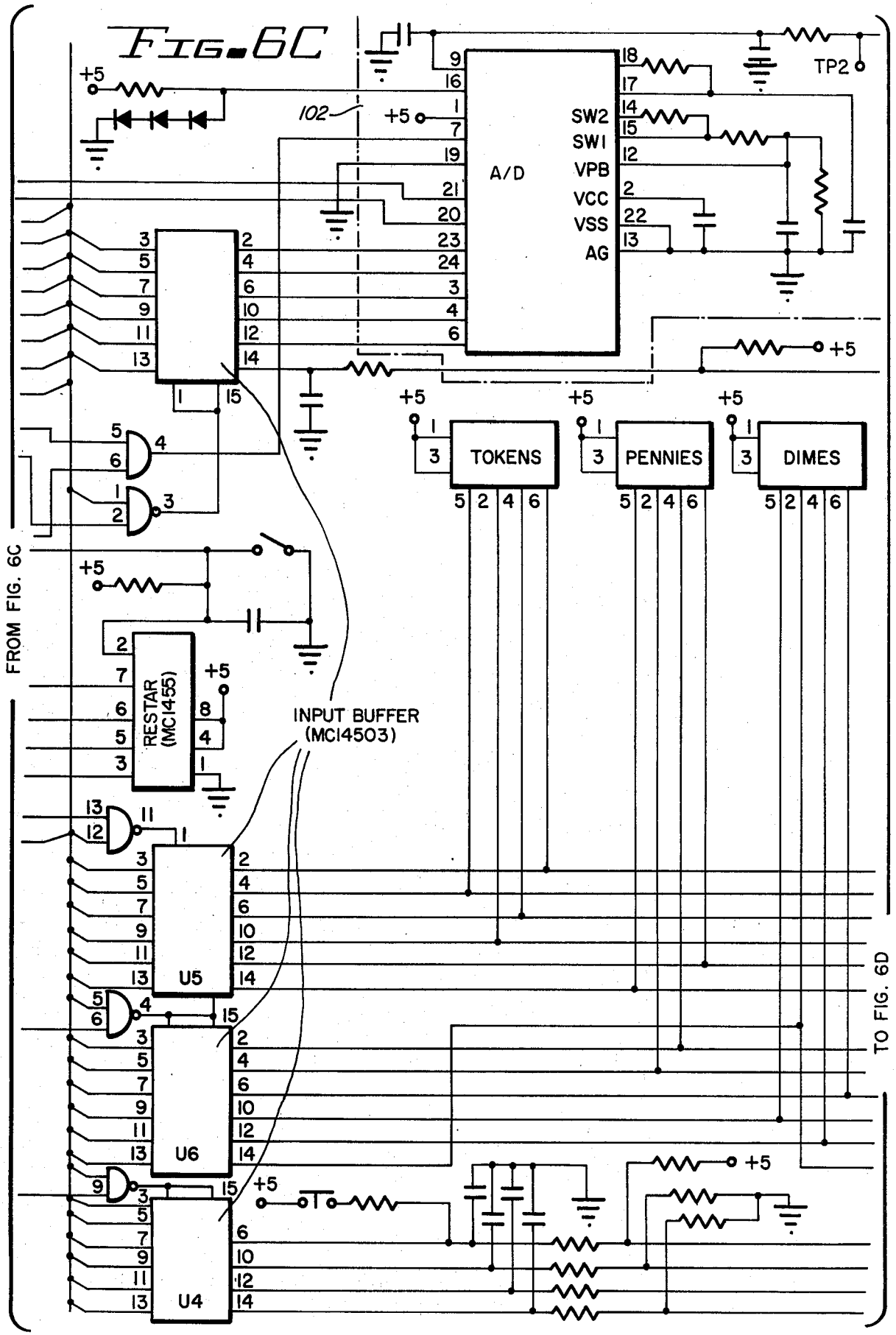
Figure 6D:
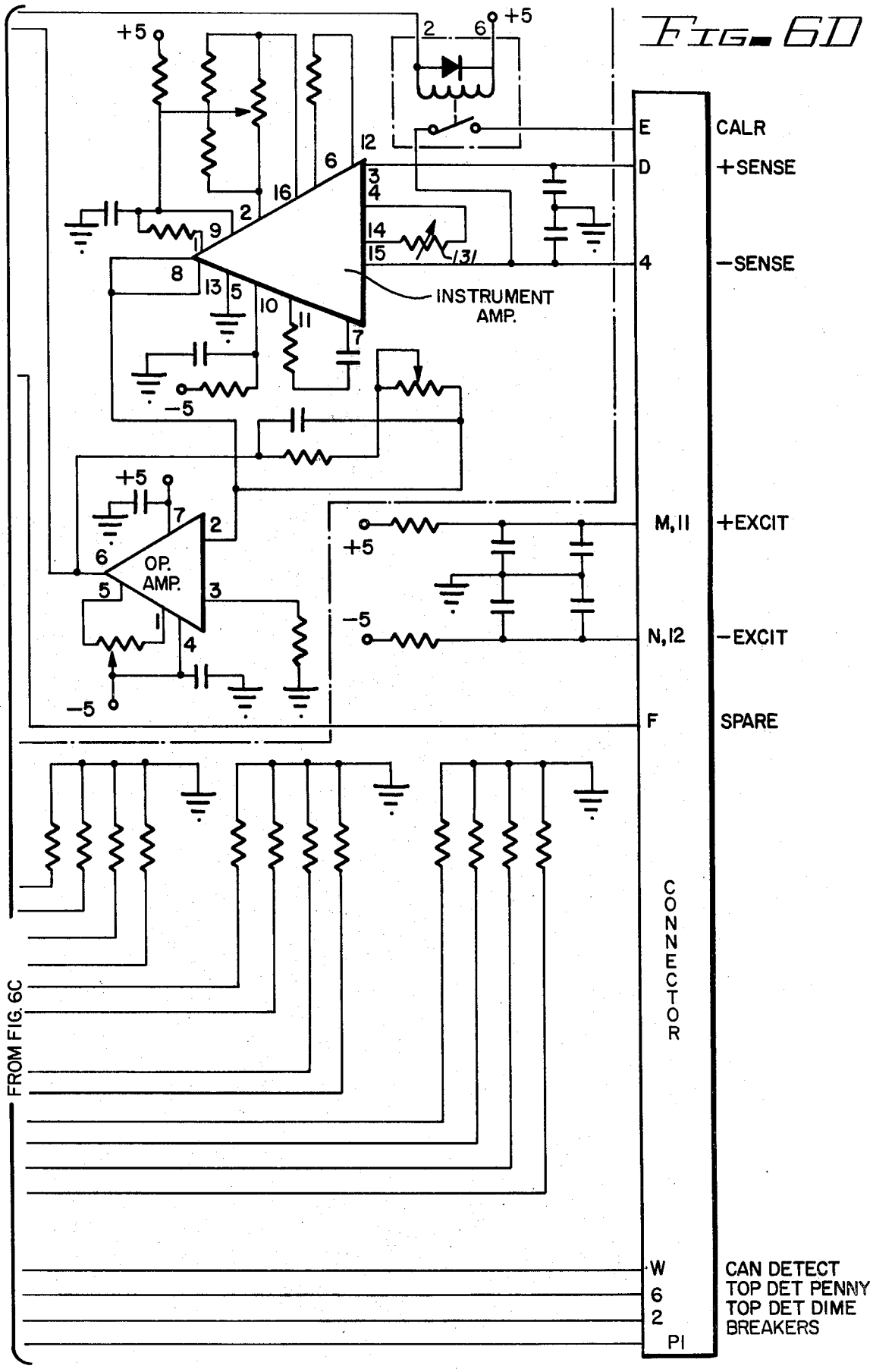

FIG. 5 is a wiring diagram of controller 30 of apparatus 20. Power for apparatus 20 flows through fuses 118 and solenoid powered relays 120. The I/O Ports $P_1$–$P_6$, 121, 122, 123, 124, 125, and 126 of FIG. 5 transmit signals to and from MPU 84 (see FIG. 6B) using connector 51 while circuit TS1 128 has applied to it alarm signals as indicated. Proper operation of the storage, or stacker motor 38 is sensed by the voltage across register 130 which is high when motor 38 is energized and running properly and low when motor 38 stops rotating when power is applied to motor 30, for example. In FIG. 5C additional details of the circuit connections of load cell 58 to controller 30 are illustrated as are details of electromagnetic detector 80. Electromagnetic detector is substantially identical to detector 74.

Figure 2:
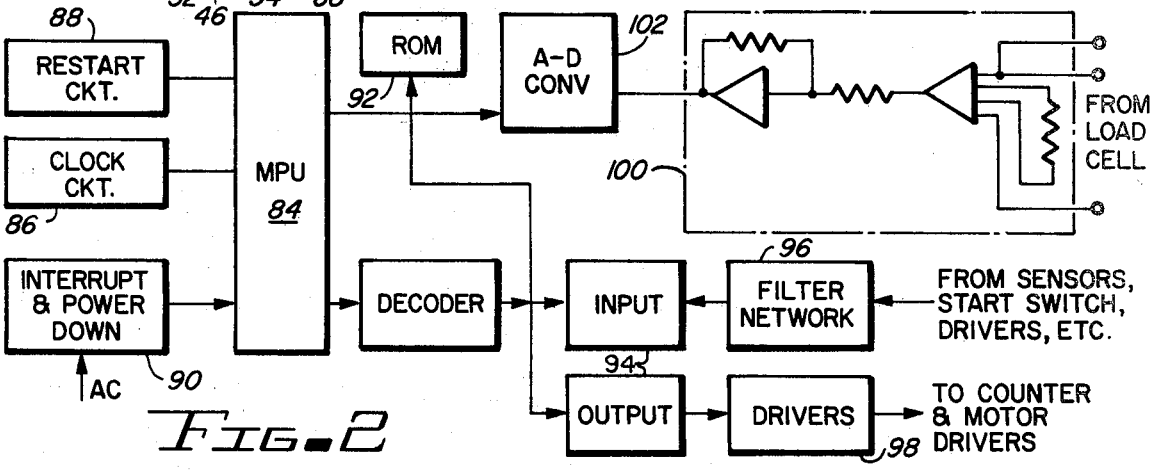
FIG. 2 is a schematic block diagram of the controller of the apparatus.
Figure 7:
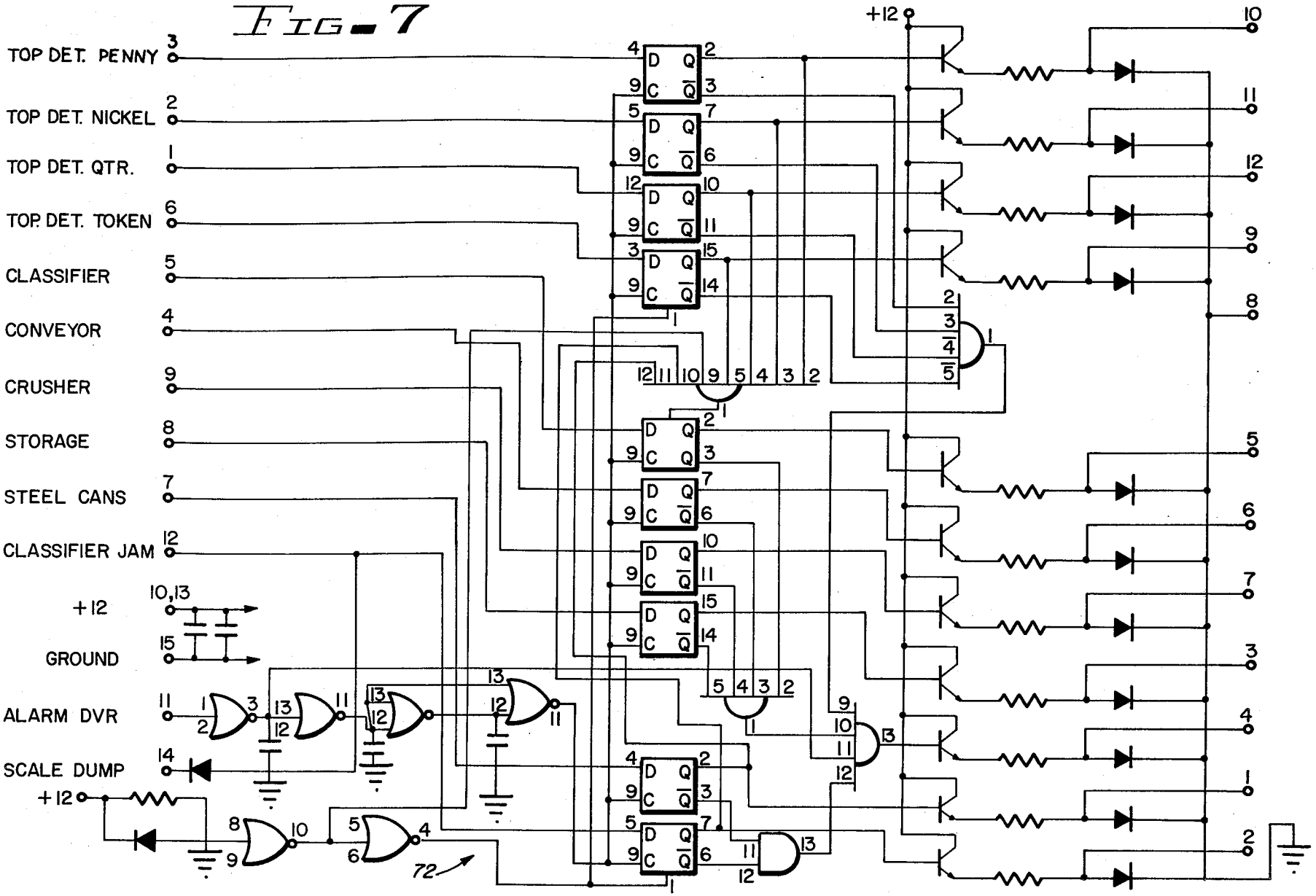
FIG. 7 is a schematic wiring diagram of the alarm indicator circuit.

FIG. 6 is a schematic diagram of the microprocessor board of controller 30. Corresponding blocks of the system schematic of FIG. 2 are identified in FIG. 6. FIG. 7 is an electrical wiring diagram of the alarm indicator 72.

The normal sequence of operation of controller 30 commences when start switch 28 is activated. Conveyor motor 32, motor 34 of classifier 48, motor 36 of crusher 54; and stacker motor 38 which drives the stacker blower 70 are turned on by controller 30 or could be sequenced on for less peak power consumption. As aluminum cans are, for example, fed into hopper 22, they fall down chute 24 and are lifted by conveyor 26. While cans are being carried up belt 26, controller 30 initiates system calibration. System calibration consists essentially of using a known resistor which is matched to that of the load cell and measuring the resulting artificially produced weight compared to the empty weight of scale bucket, or weighing hopper, 56. The difference between the empty weight of bucket 56 and the weight attributed to the known resistor represents exactly two pounds. This value is set at the start of every initial cycle. By the time cans reach the top of conveyor 26, the calibration is complete. The first can should reach scale bucket 56, in the preferred embodiment, in approximately eight seconds from time of deposit. As the cans are dumped from the conveyor belt 26 into classifier 48 all tinplated steel cans are separated out and fall into ferrous receptical 46. As each tin can falls separately into receptical 46, it will interrupt the beam of light, infrared radiation, in the preferred embodiment, of detector 74 which will produce a momentary alarm signal. Aluminum cans fall into classifier conveyor 48 and are conveyed by compressed air produced by blower 68 through conveyor 48 to crusher 54. After being crushed by crusher 54 the aluminum cans are dumped into scale bucket 56. While crushed cans are being dumped into bucket 56, controller 30 is monitoring the weight of bucket 56 as sensed by load cell 58 as the crushed cans accumulate. When this weight reaches three-quarters of a pound, in the preferred embodiment, or after waiting for a predetermined period of time, 30 seconds, conveyor 26 is shut down by deenergizing motor 32, and the remaining cans in the classifier and crusher 54 are allowed to continue to be processed and to accumulate in bucket 56 from the time conveyor belt 26 stops until hopper 56 is dumped which is approximately six seconds later. Just prior to scale or hopper dump, a final weighing is performed. The shutting off of the conveyor belt after three-quarters of a pound has been accumulated in bucket 56 prevents the scale bucket from being overloaded. It takes about two seconds to dump hopper 56. Another three seconds is used before the weight of the empty hopper 56 is measured. The empty weight of hopper 56 after it is dumped is used in determining the weight of the crushed cans dumped. By employing this method, only cans actually dumped into stacker 64 are paid for. After bucket 56 has been dumped, conveyor 26 is turned on again and cans are allowed to proceed through the system. If no cans are in the weighing hopper 56 when it is dumped, or if the weight of such cans is less than that of a given number of cans controller 30 goes into a final payout cycle and controller 30 shuts down.

If the weight of the crushed cans in hopper 56 is either three-quarters of a pound, or if it is greater than the prescribed number of cans, four for example, controller 30 repeats the above cycle with the exception that the system is not re-calibrated. The amount weighed is converted to an amount to be dispensed to the depositer based on a given amount per pound, such as twenty-five cents per pound. As apparatus 20 processes cans, the amount to be dispensed is determined by controller 30 in pennies, nickels, and quarters. Each time a quarter's worth of aluminum cans is weighed and dumped into stacker conveyor 64, a quarter is paid to the customer. On the last cycle all remaining amounts due to depositor are paid out by dispenser 60.

Five types of alarm signals are produced, (1) when one or more of the motors is not working, (2) when coin dispensers 60 are not working, (3) if the system is out of calibration, (4) if a jam occurs and (5) overflow of steel cans. Controller 30 is programmed to sense when a motor should be on, and if a motor is not running when it should be. If that is the case, out-of-order alarm 78 is turned on, and controller 30 will shut down, or stop, the operation of collector apparatus 20 and alarm indicator display 72 to display the type of failure that occurred. Operation of coin dispenser 60 is monitored in a similar manner. Each time a coin is dispensed, a request is made to put another coin in the coin tube of dispenser 60. This is done by rotating the drum of dispenser 60. Should no coins be in the drum, or should a coin be stuck, or if there is a jam in the coin dispenser, out-of-order display 72 will indicate a coin problem. The alarm is delayed for a predetermined period of time, thirty-three seconds in the preferred embodiment. A turn-on, turn-off cycle is used to try to shake loose coin jams. If within the predetermined period of time coins are placed properly in the tubes, the out-of-order alarm will not occur.

If for any reason controller 30 cannot be calibrated (that is the calibration of load cell 58 cannot be accomplished), out-of-order indicator 78 will come on and display 72 will indicate a calibration failure. The calibration failure is usually due to problems with load cell 58 such as the cable to load cell 58 not being properly plugged in. Jams from classifier 48 usually cause a backup of cans in front of crusher 54. These jams are detected by detector 80 at the time scale door 62 is opened. When such a jam occurs, the output of detector 50 produces a classifier alarm which is displayed on out-of-order display 72 and controller 30 will shut down apparatus 20 and energize out-of-order alarm 78.

Detectors 74 and 78 detect special failure of collector apparatus 20. Detector 74 monitors the level of steel cans that have been put into steel can receptical 46 and will provide a continuous output signal when this level reaches the maximum allowable level. Detector 74 also provides an audible alarm whenever a steel can drops into the ferrous material receptical 46. An infrared light beam of detector 74 and a IR sensor are used to generate this signal. When the light beam is not interrupted, the signal is low. When the light beam is broken, a high level logic one signal is produced. This signal is coupled into buzzer 75 via a one-shot multivibrator. The length of time the buzzer is energized will always be the same regardless of the length of the input pulse. Detector 80 operates in substantially the same way as detector 74 except that its location is such that it can detect cans which are piled up in front of crusher 54. Sensor 80 is enabled to produce an alarm signal on at the time the scale dump signal is transmitted by controller 30. Should there be cans blocking the light when sensor 80 is enabled, a jam has occurred an an alarm is sent to controller 30.

The magnitude of calibration resistor 131 is chosen to match that of load cell 58 if hopper 56 has two pounds of crushed cans in it, or it produces a voltage equivalent to that of two pounds. The differential change in voltage $V_{1/lb}$ is measured for a one-pound deflection on the load cell, then the voltage $V_{test}$ is measured across known resistor $R_{test}$. From this information, the valve of resistor 131 is calculated, as follows:

$$R_{131} = R_{test}\left(\frac{V_{test}}{2 \times V_{1/lb}}\right)$$

Once the value of resistor 131 is calculated, it is tested to determine that it is accurate with respect to two pounds of weight being placed in weighing hopper 56.

By using this technical approach to load cell matching with the calibration resistor 131, the following system advantages are achieved:

1. Power supply voltage fluctuations do not affect pay out.
2. Temperature variations that affect components will not affect payout.
3. Changes in bucket weight will not affect pay out.
4. Either load cell or controller can be changed without affecting payout.
5. Improved weighing accuracy.

Figure 8A:
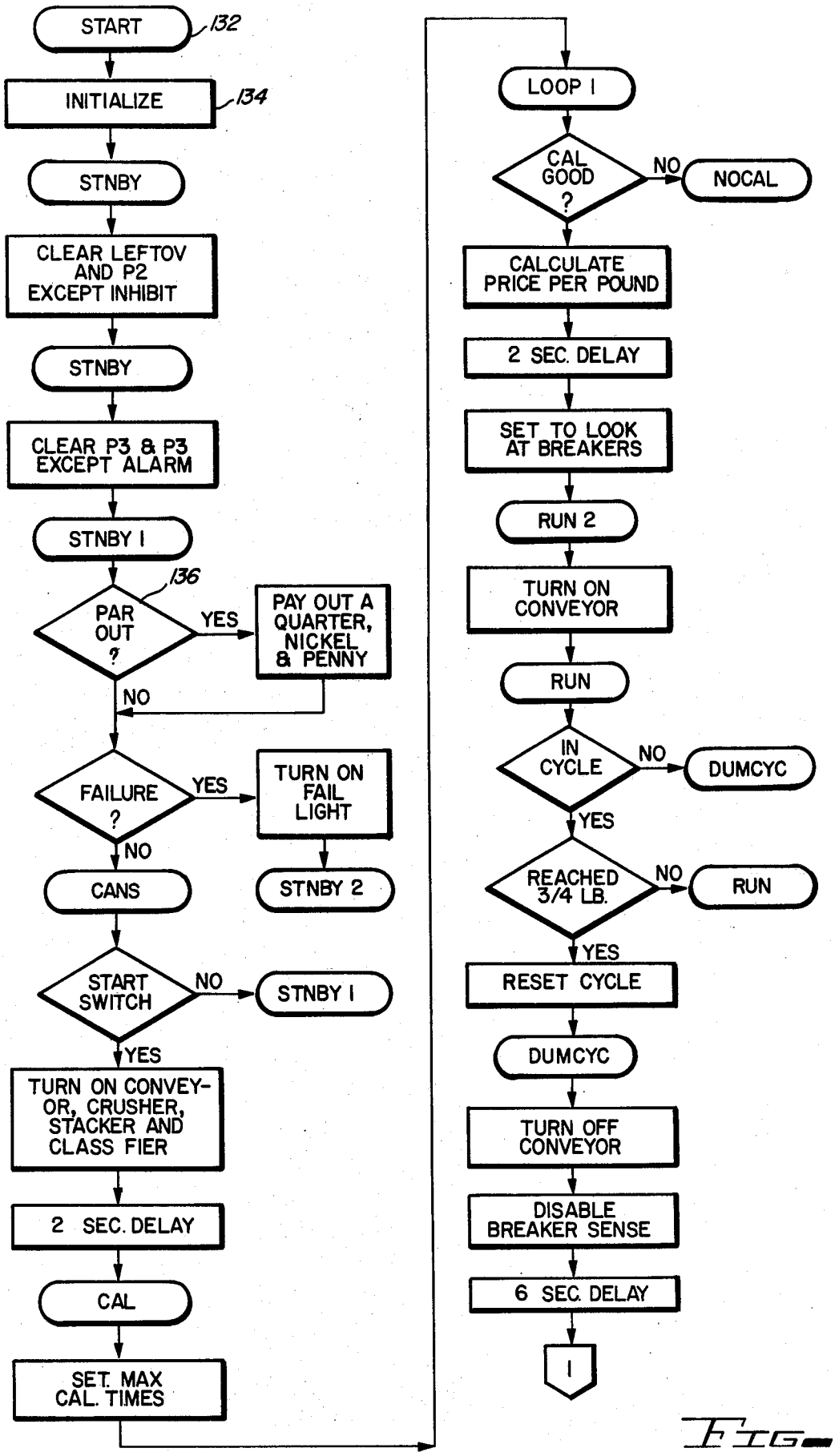
FIGS. 8A and 8B are a system flowchart for the collection apparatus.
Figure 8B:
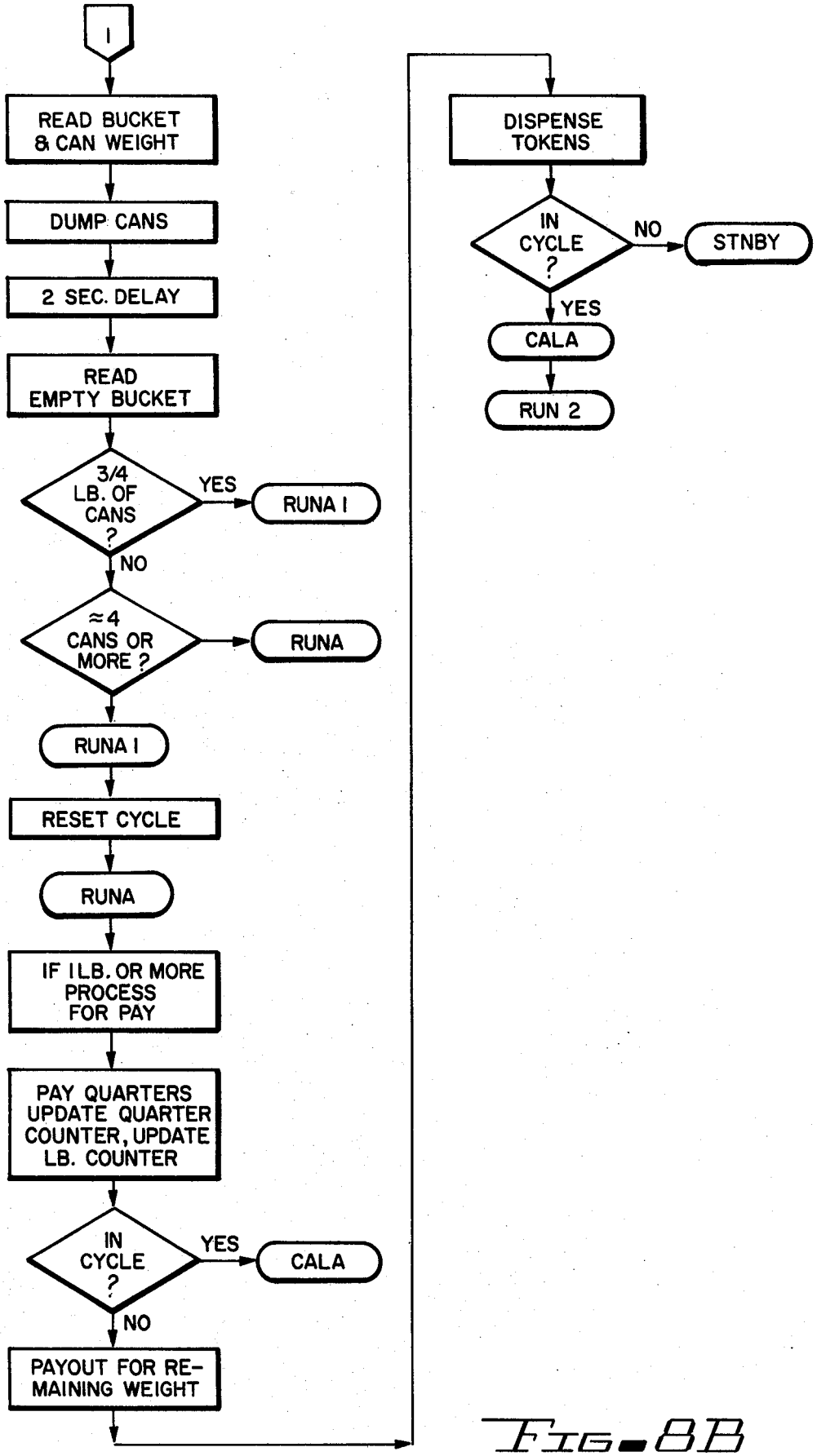

In FIGS. 8A and 8B, the system flowchart of collection apparatus 20 is illustrated. The program is entered at the label start 132. The first Action is to initialize microprocessor 84, block 134. This is accomplished by clearing all random access memory (RAM) and setting up system constants. Once the microprocessor 84 is initialized, controller 30 is ready for use. As the program progresses, output ports $P_2$, $P_3$ and $P_4$ are cleared. Next processor 84 tests for a par out request, test block 136. Each par out request results in the activation of each of the coin dispensers once producing a quarter, a penny and a nickel. Once a par out is requested, the tubes on the coin dispenser 60 are disabled. This prevents the coin tubes from being filled again which in turn allows all coins in the tubes to be dispensed. This is important when an exact control of the amount of money is required.

Should there be no par out, the microprocessor 84 checks for a failure, or for an alarm signal. Alarm signals are detected in the interrupt routine. Processor 84 is now ready to monitor start switch 28. Once start switch 28 is activated, apparatus 20 is in cycle. The cycle starts by turning on power to the motors 32, 34, 36, and 38. A predetermined delay, two seconds for example, is entered next. This delay allows sufficient time for mechanical stabilization of apparatus 20.

After stabilization, the calibration routine is entered. First a typical value of three times is established for the number of attempts at calibration that will be tried. Calibration resistor 131 is switched in, and after a delay of a few milliseconds, the voltage across the calibration resistor is measured and digitized. The relay or MOS switch (MC14066 made by Motorola) controlling the calibration is then turned off, and the normal reading of load cell 58 is used thereafter. The difference between the normal reading and the calibration reading represents exactly two pounds of weight. This is used as the weighing standard as long as this cycle continues. Once a good calibration is achieved, the price per pound is calculated and placed in memory for later use. After still another delay, the system is set up using solid-state switches, to sense, for motor failures. The program is now in two parallel loops. One loop is a thirty-second time out loop, and the other loop is a three-quarter pound in scale bucket 56 loop. The system will go into its dump cycle whenever either of these loops is completed. When the program is in its dump cycle (DUMCYE label), conveyor motor 32 is turned off and its breaker/motor sense is disabled. A fixed period of time, approximately six seconds, is allowed to clear cans from conveyor 48. When this six-second period ends, bucket 56 is weighed, and its weight expressed as a voltage is converted into a digital quantity by A2D converter 102. Bucket 56 is then dumped, and after a delay of two seconds, the empty weight of bucket 56 is measured. The difference between the weight of bucket 56 when empty and its weight with cans in it, is the weight of the cans dumped into stacker conveyor 64. If the weight of four or more cans is measured in bucket 56, a second cycle of operation is set. Each time a pound of cans is received, pound counter 138 is incremented once. The amount of money to be paid is accumulated, and each time a quarter's worth of cans is received, a quarter is paid out by dispenser 60. This cycle continues, in the preferred embodiment, until less than four cans are received in a cycle. Once this occurs, controller 30 goes into its payout cycle where money to be paid to a depositor is paid out as quarters, penneys and nickels.

If during a cycle a preset number of pounds of cans is received, a token can be dispensed by dispenser 60. Should the no-cycle flag still be set, then controller 30 shuts off, and the operation is completed. Each time a start switch 28 is activated, a similar cycle of operation is started.

While the invention has been particularly described and shown in reference to the preferred embodiments thereof, it will be understood by those skilled in the art that various changes in form and detail and omissions may be made therein without departing from the spirit and scope of the invention.

What is claimed is:

1. Collection apparatus for collecting scrap metal of a given type and for compensating depositors of said scrap metal of a given type based on the weight of said scrap metal of a given type deposited, comprising:

first means adapted to have scrap metal including metal of said given type placed into it;

classifier means for classifying and separating said scrap metal of a given type from other scrap metal, for depositing scrap metal which is not of said given type in a first receptical, and for depositing the scrap metal of said given type into a classifier;

a first conveyor having a first conveyor motor for transporting scrap metal deposited in the first means to the classifier;

a crusher powered by a crusher motor for crushing scrap metal;

a classifier conveyor for transporting scrap metal of said given type to the crusher;

a weigher having a hopper for weighing material deposited in the hopper, said weigher being positioned so that the material passing through the crusher is deposited in the hopper, said weigher including means for producing electrical signals which are a function of the weight of the hopper and of material placed in the hopper from the crusher;

means for dumping the contents of the hopper responsing to a dump control signal;

a storage compartment for said metal of a given type;

a stacker for conveying crushed metal of a given type when dumped from said hopper to the storage compartment for storage in said compartments;

a coin dispenser responsive to control signals for dispensing compensation to the depositor and for producing an alarm signal identifying the absence of the coins to be dispensed and a jam of the dispenser;

means for producing an alarm signal if any motors of the apparatus are energized and not operating properly;

means for producing an alarm signal if metal is deposited in the first receptical and if the first receptical is full of metal;

means for producing an alarm signal if the classifier conveyor is jammed;

an alarm and an out-of-order display; and control means for producing control signals for energizing the motors, for calibrating the weighing system, for dumping the hopper, for determining the weight of the first type of metal deposited in the storage compartment and the amount of compensation to be paid to the depositor, and for producing control signals to control the dispensing of compensation, said control means sensing any alarm signals produced and responsive to any such alarm signals for energizing the alarm and the out-of-order display and for deenergizing the apparatus if the condition causing an alarm signal persists for more than a predetermined period of time.

2. Collection apparatus as defined in claim 1 in which the scrap metal of a given type is aluminum.

3. Collection apparatus as defined in claim 2 in which said other scrap metal is a ferromagnetic material.

4. The apparatus of claim 1 in which means for producing an alarm signal if any of the motors of the apparatus are energized and not operating properly includes a resistor connected across a winding of each motor.

5. The apparatus of claim 4 in which the means for producing an alarm signal if metal is deposited in the first receptical includes an electromagnetic radiation detector.

6. The apparatus of claim 5 in which the electromagnetic radiation detector operates in the infrared spectrum.

7. The apparatus of claim 1 in which the means for producing an alarm signal if the classifier conveyor is jammed includes an electromagnetic radiation detector.

8. The apparatus of claim 7 in which the electromagnetic radiation detector operates in the infrared spectrum.

9. The apparatus of claim 1 in which the control means includes a microprocessor.

10. The apparatus of claim 9 in a which control means determines the weight of the first type of metal deposited in the storage compartment by weighing the hopper with the crushed scrap metal of said given type immediately prior to dumping the contents of the hopper and by weighing the hopper immediately after dumping the contents.

11. In a collection apparatus for collecting scrap metal and for compensating depositors of such first type of metal as a function of the weight of the first type of metal deposited in the storage compartment of the apparatus, said apparatus having an input hopper, a start button, a first conveyor for conveying scrap metal from the hopper to a classifier, said classifier segregating a second type of metal from the first type, depositing the second type of metal in a second type of metal receptical and for depositing the first type of metal in a classifier conveyor, said classifier conveyor transporting the first type of metal to and loading said material into a crusher; said crusher crushing the first type of said metal and loading it into a weigher bucket of a weigher which measures the weight of the weigher bucket and its contents; a stacker for conveying the first type of metal after being weighted to the storage compartment; the improvements comprising:

a digital electronic controller responsive to a signal from the start button for energizing the first conveyor, the classifier, the crusher and the stacker, for calibrating the weigher, for weighing materials dumped in the bucket of the weigher, for dumping the materials from the hopper into the stacker for storage in the compartment, for dispensing compensation for the material weighed, and for stopping operation when there are no more cans to be processed;

an alarm display;

means for producing a motor alarm signal if the first conveyor, the classifier, the crusher, or the stacker is not functioning when energized;

means for producing a second type metal alarm each time a second type is deposited in the second type metal receptical and for producing a second type metal overflow alarm if the second type metal receptical is full;

means for producing a classifier jam alarm signal if metal is detected at the entrance of the crusher when the weight bucket is emptied; and means for producing a dispenser alarm signal if the dispenser malfunctions; said control system responsive to any such alarm signals causing the alarm display to be enabled to identify the source of the alarm signal and to stop further operations of the apparatus.

12. In a collection apparatus as defined in claim 11 in which the first type of scrap metal is aluminum.

13. In a collection apparatus as defined in claim 11 in which the second type of metal is ferromagnetic.

14. In a collection apparatus as defined in claim 11 in which the means for producing a second type metal alarm signal includes electromagnetic radiation producing and detecting means.

15. In a collection apparatus as defined in claim 14 in which the electromagnetic radiation is in the infrared spectrum.

16. In a collection apparatus as defined in claim 11 in which the means for producing a classifier jam alarm signal includes electromagnetic radiation producing and detecting means.

17. In a collection apparatus as defined in claim 16 in which electromagnetic radiation is in the infrared spectrum.

18. In a collection apparatus as defined in claim 11 in which the controller includes a microprocessor.

19. Collection apparatus for collecting aluminum cans and for compensating depositors of aluminum cans based on the weight of the aluminum can deposited, comprising:

deposit means adapted to have aluminum cans placed into it;

classifier means for classifying and separating ferrous from non-ferrous metal, for depositing ferrous metal in a first receptical and for depositing aluminum cans into a classifier conveyor;

a first conveyor having a first conveyor motor for transporting aluminum cans placed in said deposit means to the classifier;

a can crusher powered by a crusher motor for crushing cans;

said classifier conveyor transporting aluminum cans to the can crusher;

a weigher having a hopper for weighing material deposited in the hopper, said weigher being positioned so that the material passing through the crusher is deposited in the hopper, said weight including means for producing electrical signals which are a function of the weight of the hopper and material placed in the hopper from the crusher;

means for dumping the contents of the hopper responsive to a dump control signal;

a storage compartment for crushed aluminum cans;

a stacker for conveying crushed aluminum cans dumped from the hopper to the storage compartment;

a coin dispenser responsive to control signals for dispensing compensation to the depositor and for producing an alarm signal identifying the absence of coins to be dispensed and a jam of the dispenser;

means for producing a motor alarm signal if any of the motors of the apparatus are energized and not operating properly;

means for producing a ferrous metal alarm signal if ferrous metal is deposited in the first receptical and if the first receptical is full of such ferrous metal;

means for producing a classifier alarm signal if the classifier pneumatic conveyor is jammed;

an alarm, an and out-of-order display; and control means for producing control signals to energize the motors, to calibrate the weigher, to dump the hopper, to determine the weight of the crushed aluminum cans dumped from the hopper, the amount of compensation to be paid, and for producing control signals to control the dispensing of compensation, said control means sensing any alarm signals produced and responsive to any such alarm signals for energizing the alarm and the out-of-order display, and deenergizing the apparatus if the condition causing an alarm signal persists for more than a predetermined period of time.

20. Collection apparatus as defined in claim 19 in which the means for producing electrical signals which are a function of the weight of material placed in the hopper includes a load cell and an analog to digital convertor.

21. Collection apparatus as defined in claim 20 in which the means for producing a motor alarm signal includes a resistor connected across a winding of each motor.

22. Collection apparatus as defined in claim 21 in which the means for producing a ferrous metal alarm signal includes infrared radiation producing and detecting means.

23. Collection apparatus as defined in claim 22 in which the control means determines weight of the crushed aluminum cans dumped from the hopper by measuring the weight of the hopper and contents substantially immediately prior to dumping the contents and weighing the hopper immediately after dumping its contents and before additional material is placed in the hopper.

24. In a collection apparatus for collecting aluminum cans and for compensating depositors of such cans as a function of the measured weight of the aluminum cans deposited in the storage compartment of the apparatus, said apparatus having an input hopper, a start button, a first conveyor for conveying material from the hopper to a classifier, said classifier segregating ferrous metal from non-ferrous metal, depositing ferrous metal in a ferrous metal receptical and for depositing aluminum cans in a classifier conveyor, said classifier conveyor transporting the aluminum cans to and loading said cans into a crusher;

said crusher crushing the aluminum cans and loading the crushed cans into a weigher bucket of a weigher which measures the weight of the weigher bucket and the crushed aluminum cans in said bucket; a stacker for conveying crushed aluminum cans after being weighed and when dumped from the bucket to the storage compartment; the improvement comprising:

a digital electronic controller responsive to a signal from the start button for energizing the first conveyor, the classifier, the crusher and the stacker, for calibrating the weigher, for determining the weight of materials dumped in the bucket of the weigher, for dumping the materials in the bucket after being weighed into the stacker for storage in the compartment, for dispensing the compensation for the material weighed, and for stopping operation when there are no more cans to be processed;

an alarm display;

means for producing a motor alarm signal if the first conveyor, the classifier, the crusher, or the stacker is not functioning when energized;

means for producing a ferrous metal alarm each time a ferrous metal object is deposited in the ferrous metal receptical and for producing a ferrous metal overflow alarm if the ferrous metal receptical is full;

means for producing a classifier jam alarm signal if metal is detected at the entrance of the crusher when the bucket is emptied;

means for producing an alarm signal if the dispenser malfunctions; said controller responsive to any such alarm signals, casing the alarm display to be enabled to identify the source of the alarm signal and to stop further operation of the apparatus.

25. In the collection apparatus of claim 24 in which the means for producing a motor alarm signal includes a resistor across a winding of each motor.

26. In the collection apparatus of claim 25 in which the means for producing a ferrous metal alarm signal includes means for producing an infrared beam and means for detecting when said beam is broken.

27. In the collection apparatus of claim 26 in which the controller determines the weight of materials dumped into the stacker by measuring the weight of the bucket and its contents immediately prior to dumping the contents and by measuring the weight of the bucket immediately after its contents have been dumped, using the difference as being the weight of the materials dumped into the stacker.

28. The method of controlling collection apparatus for collecting aluminum cans and for compensating a depositor of such cans as a function of the weight of the aluminum cans deposited in the storage compartment of the apparatus, said apparatus having an input means, a start button, a first conveyor for conveying material from the input means to a classifier, said classifier segregating ferrous metal from non-ferrous metal, depositing ferrous metal in a ferrous metal receptical and for depositing ferrous metal in a ferrous metal receptical and for depositing aluminum cans in a classifier conveyor; said classifier conveyor transport aluminum cans to and loading said cans into a crusher, said crusher crushing aluminum cans and loading crushed cans into a weigher bucket of a weigher which measures the weight of the weigher bucket and the crushed aluminum cans in said bucket; a stacker for conveying the crushed aluminum cans after being weighed and dumped into the storage compartment, the method comprising:

sensing when the start button is pushed;

energizing the first conveyor, the classifier, the crusher, and the stacker;

calibrating the weigher;

determining the weight of materials dumped in the bucket of the weigher;

dispensing compensation based on the weight of aluminum cans placed in the bucket; and compensating depositors based on the product of the weight of crushed aluminum cans dumped out of the bucket of the weigher times a predetermined price per pound.

29. The method of claim 28 in which the first conveyor is stopped after a predetermined weight of cans is deposited into the bucket of the weigher and not restarted until the bucket is dumped.

30. The method of claim 29 in which compensation of the depositor requires a predetermined minimum weight of crushed aluminum cans to be deposited into the bucket of the weigher.

31. In a scrap metal collection apparatus, an electronic controller comprising in combination:

means for calculating an exact standard reference weight;

means for weighing and recording the weight of a scrap metal weighing container and its scrap metal content prior to immediately dumping the container;

means for dumping the scrap metal contents of the scrap metal container;

means for weighing and recording the scrap metal weighing container after the scrap metal contents of the container are dumped;

means for computing the weight of the scrap metal contents as a ratio of the previously calculated exact standard reference weight; means for calibrating the means for weighing and recording said weighing container, said calibrating means including means for measuring said exact standard reference weight prior to the operation of said means for weighing and recording the weight of said scrap metal weighing container and its scrap metal content prior to a subsequent weighing cycle.

32. In a scrap metal collection apparatus of claim 31 in which the electronic controller includes a digital data processor.

33. In the scrap metal collection apparatus of claim 31 in which the means for calibrating performs its function at the beginning of a cycle of operation of the collector apparatus.

34. In the scrap metal collection apparatus of claim 33 in which the means for measuring the weight of the weighing container and contents substantially continuously measures their weight.

35. In the scrap metal collection apparatus of claim 34 in which the controller further includes means for limiting to a predetermined maximum, first weight, the weight of the scrap metal contents of said weighing container.

36. In the scrap metal collection apparatus of claim 35 in which the means for limiting the scrap metal contents of the weighing container, further includes means for stopping a conveyor for tansporting scrap metal a part of the way to the weighing container when the weight of the scrap metal contents in the container exceeds a predetermined second weight.

37. In the scrap metal collection apparatus of claim 36 in which the predetermined second weight is less than the first.

38. In the scrap metal collection apparatus of claim 31 in which the combination further includes means for producing a predetermined time delay between the dumping of the contents of the container and the subsequent weighing and recording of the weight of the container.

39. In the scrap metal collection apparatus of claim 38 in which the combination further includes means for determining a compensation to be paid as a function of the weight of scrap metal dumped from the weighing container and a predetermined rate of compensation per unit of weight thereof.

40. The method of controlling a scrap metal collection apparatus comprising the steps of:

calculating an exact standard reference weight;

weighing and recording the weight of a scrap metal weighing container and its scrap metal contents immediately prior to dumping the container;

dumping the scrap metal contents of the scrap metal container;

weighing and recording the weight of the scrap metal weighing container after the scrap metal contents of the container are dumped;

computing the weight of the scrap metal contents as a ratio of the previously calculated exact standard reference weight; and calibrating the step of weighing and recording the weight of the weighing container; said calibrating step including measuring the exact standard reference weight prior to the operation of the step of weighing and recording the weight of the scrap metal weighing container and its scrap metal content prior to a subsequent weighing cycle.

41. The method of claim 40 in which the weight of the scrap metal weighing container and contents is recorded digitally.

42. The method of claim 40 in which the step of calibrating occurs at the beginning of a cycle of operation of the apparatus.

43. The method of claim 42 in which the step of weighing and recording the weight of the scrap metal weighing container is performed respectively.

44. The method of claim 43 which further includes the step of limiting to a predetermined maximum first weight the weight of the scrap metal content of said weighing container.

45. The method of claim 44 in which the step of limiting the weight of said metal content of the weighing container further includes stopping the transporting of scrap metal to the weighing container a part of the way thereto when the weight of the contents of the container exceeds a predetermined second weight.

46. In the method of claim 45 in which the first weight is greater than the second.

47. The method of claim 46 in which the method further includes the step of delaying for a predetermined period of time the step of weighing and recording the weight of the container after the step of dumping the contents of said container.

48. The method of claim 47 in which the method further includes the step of determining a compensation to be paid as a function of the weight of scrap metal dumped from the weigher container and a predetermined rate of compensation per unit of weight thereof.

49. In the scrap metal collection apparatus of claim 31 wherein said calibration means for accurately calibrating said weighing operation comprises a load cell and a matching resistor.

* * * * *

UNITED STATES PATENT AND TRADEMARK OFFICE

CERTIFICATE OF CORRECTION

PATENT NO. : 4,402,391

DATED : September 6, 1983

INVENTOR(S) : William J. Tuten et al.

It is certified that error appears in the above-identified patent and that said Letters Patent is hereby corrected as shown below:

Claim 11, line 17, "weighted" should read -- weighed --.

Claim 19, line 21 "weight" should read -- weigher --.

Claim 36, line 4, "tansporting" should read -- transporting --.

Signed and Sealed this

*Fourteenth* Day of *February 1984*

[SEAL]

*Attest:*

GERALD J. MOSSINGHOFF

*Attesting Officer*

*Commissioner of Patents and Trademarks*